US009387393B2

(12) United States Patent
Bazarko

(10) Patent No.: US 9,387,393 B2
(45) Date of Patent: Jul. 12, 2016

(54) GAME WITH TIMER DEVICE AND METHOD OF PLAYING THE GAME

(71) Applicant: Mattel, Inc., El Segundo, CA (US)

(72) Inventor: Jeffrey W. Bazarko, Hawthorne, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/582,402

(22) Filed: Dec. 24, 2014

(65) Prior Publication Data

US 2015/0182851 A1 Jul. 2, 2015

Related U.S. Application Data

(60) Provisional application No. 61/922,333, filed on Dec. 31, 2013.

(51) Int. Cl.

| | |
|---|---|
| ***A63F 9/28*** | (2006.01) |
| ***A63F 11/00*** | (2006.01) |
| ***A63F 9/30*** | (2006.01) |
| *A63H 11/04* | (2006.01) |
| *A63F 9/00* | (2006.01) |
| *A63H 1/30* | (2006.01) |

(52) U.S. Cl.

CPC . *A63F 11/00* (2013.01); *A63F 9/30* (2013.01); *A63F 9/0096* (2013.01); *A63F 9/28* (2013.01); *A63F 2250/1063* (2013.01); *A63F 2250/1073* (2013.01); *A63F 2250/128* (2013.01); *A63H 1/30* (2013.01); *A63H 11/04* (2013.01)

(58) Field of Classification Search

CPC ..... A63H 11/04; A63H 1/30; A63F 9/0098; A63F 9/28; A63F 9/30; A63F 2250/1063; A63F 2250/128; A63F 9/009; A63F 2250/1286

USPC ..... 446/315, 314, 490; 273/445–448, 273/148 R, 241, 282.1, 287

See application file for complete search history.

(56) References Cited

U.S. PATENT DOCUMENTS

| | | | |
|---|---|---|---|
| 240,510 | A | 4/1881 | Farnum |
| 243,439 | A | 6/1881 | Farnum |
| 257,952 | A | 5/1882 | Kennish |
| 485,713 | A | 11/1892 | Shattuck |
| 545,958 | A | 9/1895 | Hoffmann |
| 731,051 | A | 6/1903 | Hills |
| 809,092 | A | 1/1906 | Carpenter |
| 1,211,479 | A | 1/1917 | Myers |
| 1,267,608 | A | 5/1918 | Vaughan |
| 1,323,002 | A | 11/1919 | Bowman |
| 1,332,601 | A | 3/1920 | Burke |
| 1,441,055 | A | 1/1923 | Bellew |

(Continued)

FOREIGN PATENT DOCUMENTS

DE WO 0025879 A1 * 5/2000 ..... A63H 33/00

*Primary Examiner* — Benjamin Layno

(74) *Attorney, Agent, or Firm* — Sheppard, Mullin, Richter & Hampton LLP

(57) ABSTRACT

A timer mechanism for a game is disclosed herein. The timer mechanism including: an end portion; an object secured to the end portion by a retractable member capable of being extracted from the object and retracted into the object by a winding mechanism; and an indicator mechanism located at the end portion for indicating when the object has come into proximity with the end portion and has contacted a portion of the indicator mechanism through retraction of the retractable member into the object by the winding mechanism.

18 Claims, 12 Drawing Sheets

(56) References Cited

U.S. PATENT DOCUMENTS

| | | | | |
|---|---|---|---|---|
| 1,462,090 | A | | 7/1923 | Lindstrom |
| 1,472,842 | A | | 11/1923 | Hyman |
| 1,638,910 | A | | 8/1927 | Boggio |
| 1,784,684 | A | | 12/1930 | Bell |
| 2,064,119 | A | | 12/1936 | Irenius |
| 2,387,565 | A | | 10/1945 | Criner |
| 2,518,041 | A | | 8/1950 | Marschalk |
| 2,518,840 | A | | 8/1950 | Tunstall |
| 2,547,943 | A | | 4/1951 | Huntsberry |
| 2,550,065 | A | | 4/1951 | Hallum |
| 2,565,096 | A | | 8/1951 | Schelm |
| 2,572,752 | A | | 10/1951 | Ostrander |
| 2,766,551 | A | | 10/1956 | Almoslino |
| 2,888,776 | A | | 6/1959 | Sauer |
| 3,328,910 | A | | 7/1967 | Hughes |
| 3,339,921 | A | | 9/1967 | Glass et al. |
| 3,393,470 | A | | 7/1968 | Salvador |
| 4,056,896 | A | | 11/1977 | Karasawa |
| 4,302,902 | A | | 12/1981 | Adler |
| 4,571,210 | A | | 2/1986 | Zaruba et al. |
| 4,576,586 | A | | 3/1986 | Amici et al. |
| 4,682,968 | A | | 7/1987 | Droller et al. |
| 4,826,160 | A | | 5/1989 | Kobayashi |
| 4,880,231 | A | * | 11/1989 | Kobayashi ..... A63F 9/30 273/448 |
| 4,973,053 | A | | 11/1990 | Kobayashi |
| 5,320,572 | A | | 6/1994 | Chen |
| 5,443,261 | A | | 8/1995 | Lee et al. |
| 5,727,981 | A | | 3/1998 | Meng-Suen |
| 5,743,781 | A | | 4/1998 | Lee |
| 5,755,610 | A | | 5/1998 | Lin |
| 5,836,801 | A | | 11/1998 | Lin |

* cited by examiner

GAME WITH TIMER DEVICE AND METHOD OF PLAYING THE GAME

CROSS REFERENCE TO RELATED APPLICATIONS

This application claims the benefit of U.S. Provisional Patent Application Ser. No. 61/922,333, filed Dec. 31, 2014, the entire contents of which are incorporated herein by reference thereto.

BACKGROUND

Games typically involve a plurality of players, each of whom must perform a task or multiple tasks during their turns in the game. To provide an added level of excitement, some games require that a player perform the required tasks within a predetermined time period. The predetermined time period can be tracked or monitored by a simple clock mechanism. However, this may not provide an entertaining means for measuring or timing the predetermined time period in which a player must perform their task.

Accordingly, it is desirable to provide a game with an improved timer device that adds a level of excitement and/or entertainment to the game as well as a game or method for playing the game including the improved timer device.

BRIEF SUMMARY OF INVENTION

In one embodiment, a timer mechanism for a game is provided, the timer mechanism having: an end portion; an object secured to the end portion by a retractable member capable of being extracted from the object and retracted into the object by a winding mechanism; and an indicator mechanism located at the end portion for indicating when the object has come into proximity with the end portion and has contacted a portion of the indicator mechanism through retraction of the retractable member into the object by the winding mechanism.

In another embodiment a game is provided, the game comprising: a structure; an object secured to the structure by a retractable member capable of being extracted from the object and retracted into the object by a winding mechanism; and an indicator mechanism operatively coupled to the structure for indicating when the object has contacted a portion of the indicator mechanism through retraction of the retractable member into the object by the winding mechanism.

In yet another embodiment, a method of playing a game is provided. The method including the steps of: locating at least one game piece on a structure; executing a plurality of player's turns in the game until a predetermined event has occurred, wherein each player's turn includes the steps of: interacting with the at least one game piece on the structure during a predetermined time period; repositioning an object away from the structure to a timer start position in order to create a predetermined time period for the next player's turn in the game, wherein the repositioning of the object away from the structure causes a retractable member to be unwound from a winding device located within the object and wherein the unwinding of the retractable member causes the object to be drawn towards a timer end position; wherein a player is penalized if during their turn the object reaches the timer end position prior to it being repositioned away from the structure to the timer start position; and determining a winner of the game when the predetermined event has occurred.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1A:
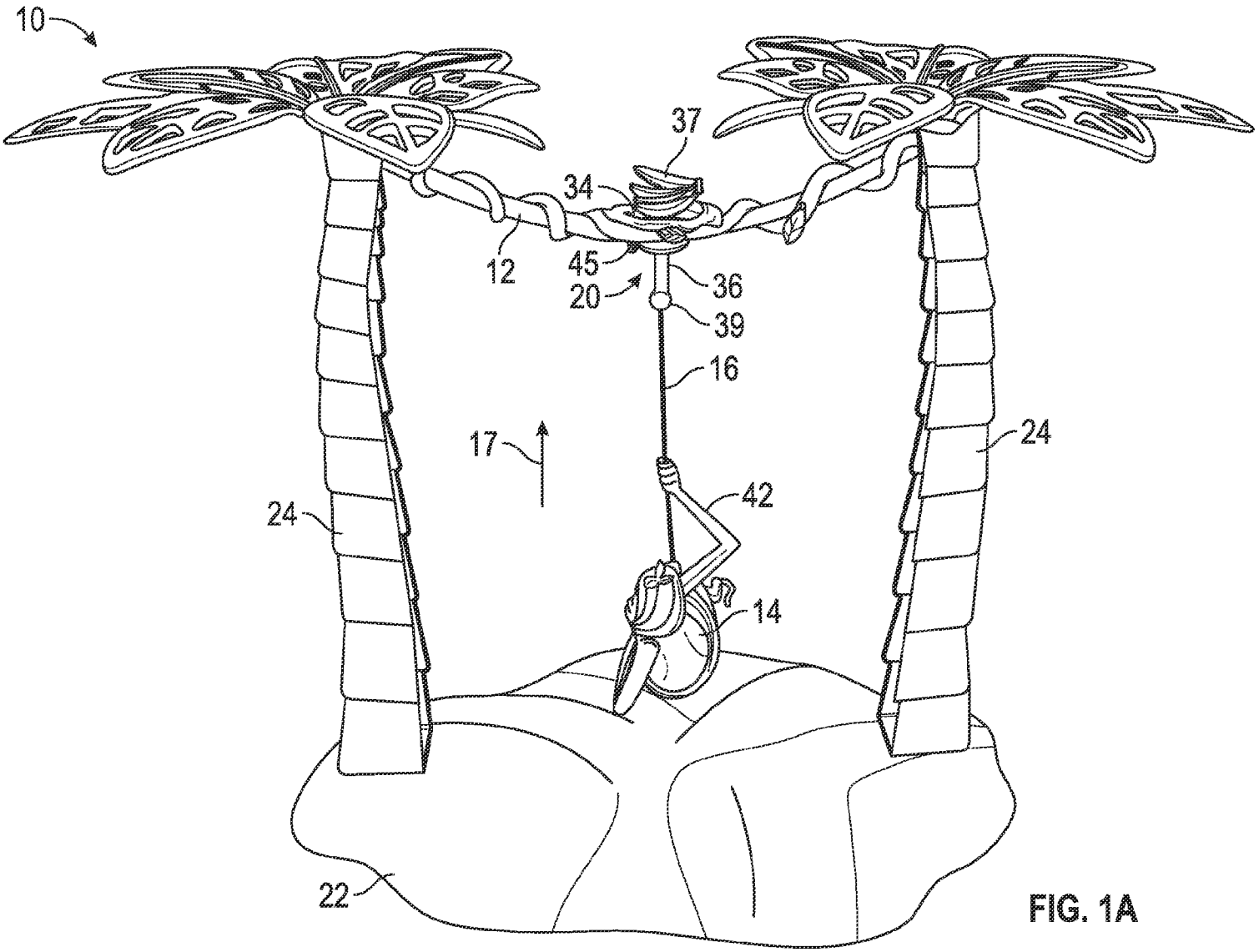
FIG. 1A is a perspective view of a timer mechanism in accordance with one embodiment of the present invention wherein the timer mechanism is at an initial or starting position.

Referring now to the FIGS. a timer mechanism 10 for a game is illustrated. In one embodiment, the timer mechanism 10 has an elevated portion 12 and an object 14 secured to the elevated portion by a retractable member 16 capable of being extracted from the object 14 and retracted into the object 14 by a winding mechanism 18. Operation of the winding mechanism 18 causes the object 14 to be drawn to the elevated portion 12 when the object 14 has been pulled downwardly and away from the elevated portion 12.

The timer mechanism 10 also has an indicator or indicator mechanism 20 for indicating when the object 14 has been brought into contact with the elevated portion 12 through retraction of the retractable member 16 into the object 14 by the winding mechanism 18.

In one non-limiting embodiment, the elevated portion is an elongated member supported above a base member 22 of the timer mechanism 10 by a pair of vertical members 24. In one embodiment, the pair of vertical members are configured to resemble palm trees and the elongated member is configured to resemble a vine extending therebetween. Still further and in one embodiment, the object 14 is configured to resemble a monkey.

In one embodiment and as illustrated in the attached FIGS., the retractable member 16 is a cord or string secured to the elevated portion 12 at one end and the winding mechanism 18 at the other. For example and as illustrated in at least FIG. 3B, an end 15 of the retractable member 16 is secured to the elevated portion 12.

Referring now to at least FIGS. 4 and 5A-5C, the winding mechanism 18 has a spool member 26 rotatably mounted to a housing 28 of the winding mechanism 18. The winding mechanism 18 is located within a housing 29 of the object 14. The spool member 26 is coupled to a spring member 30 configured to rotate the spool member 26 in a first direction 32 after the spool member has been rotated in a second direction. In the illustrated embodiment, the second direction is opposite to the first direction. The second direction also corresponds to the extraction of the retractable member 16 from the object 14. In other words, as the object 14 is pulled downward from the elevated portion 12 towards the base member 22, the retractable member 16 is extracted from the winding mechanism. During this movement, the spool member 26 rotates in the second direction, thus causing the spring member 30 to provide a biasing force in the first direction 32, which is opposite to the second direction, such that when released the object 14 is drawn back towards the elevated portion 12 via operation of the winding mechanism.

Figure 4:
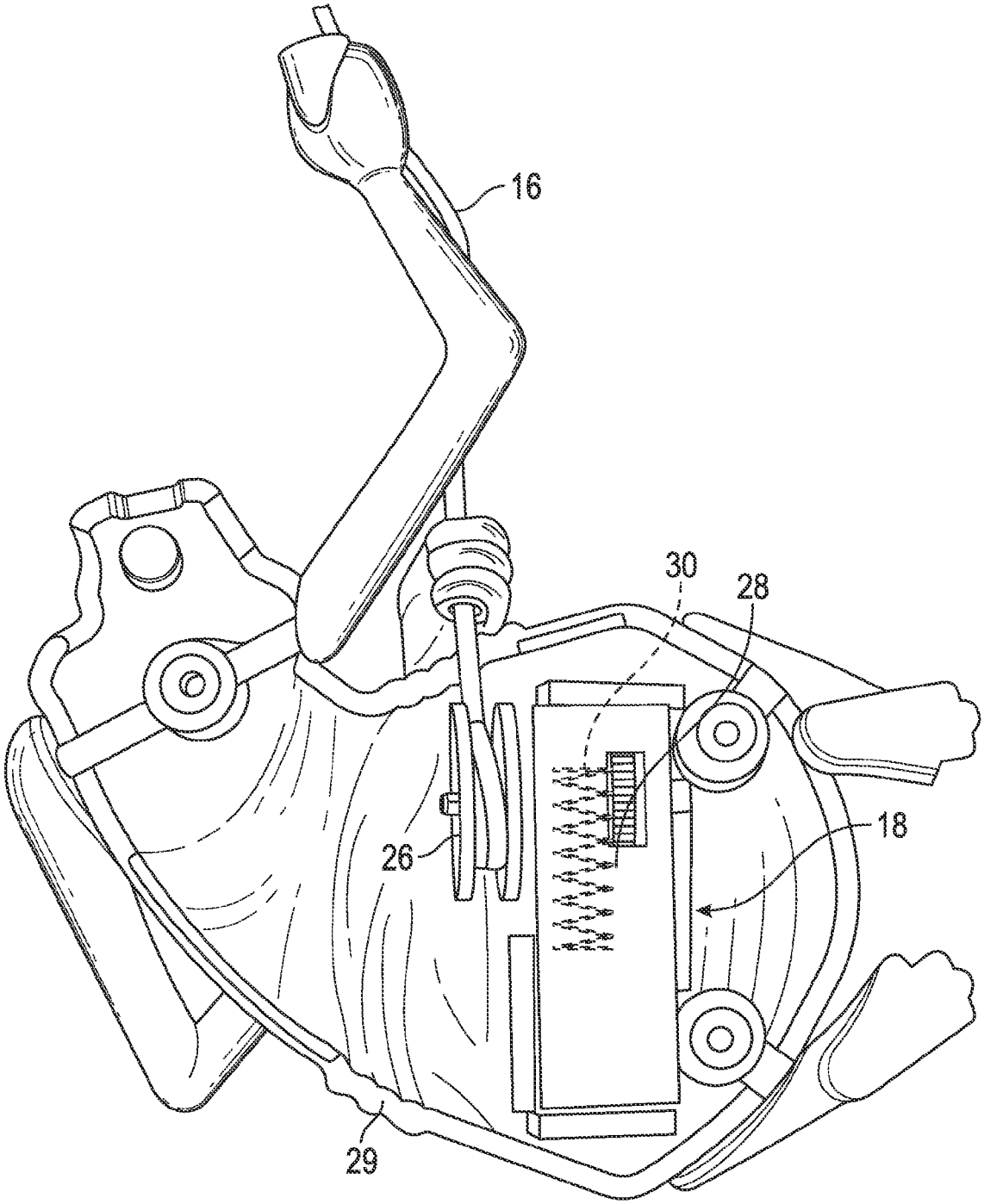
FIG. 4 is an interior view of a portion of the timer mechanism.
Figure 4A:
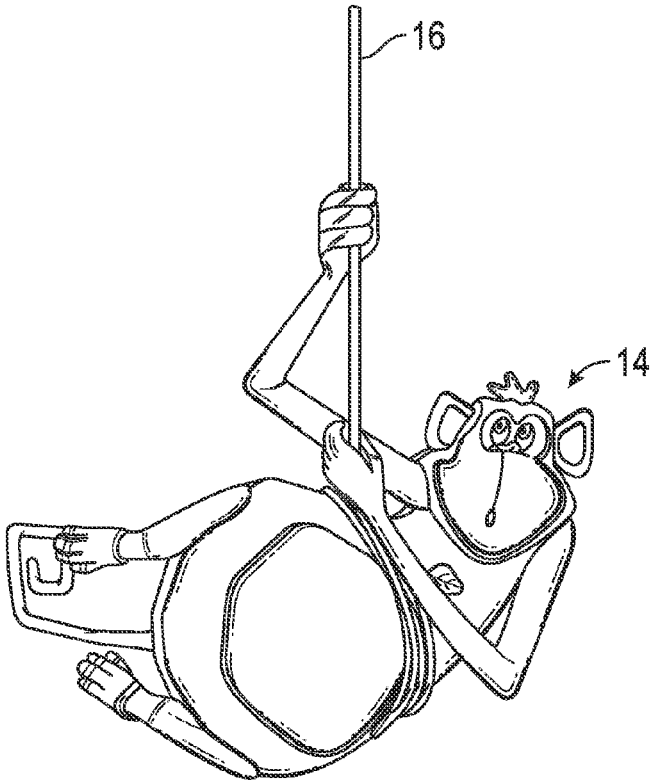
FIG. 4A is a front view of a portion of the timer mechanism.
Figure 4B:
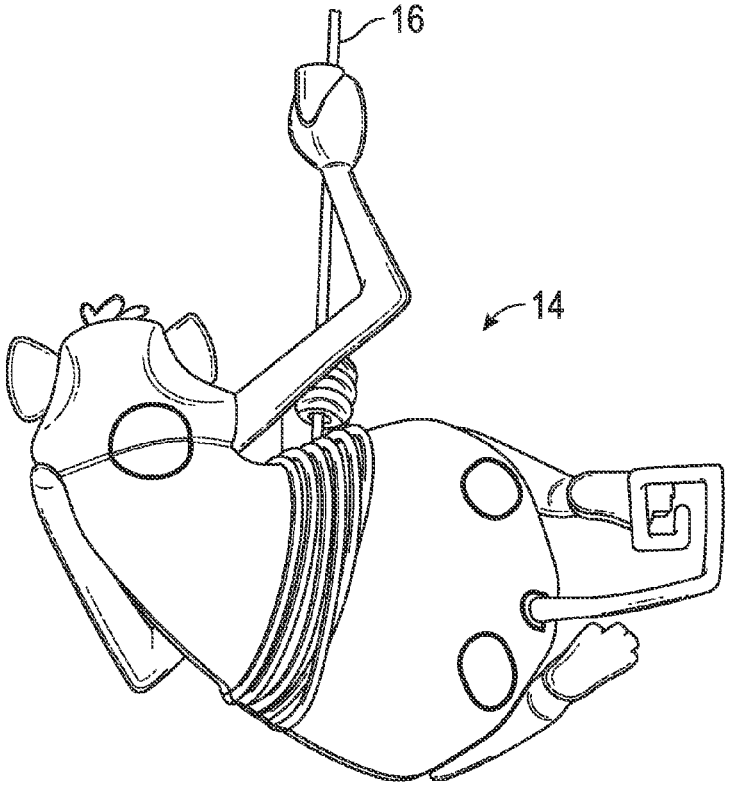
FIG. 4B is a rear view of a portion of the timer mechanism.
Figure 5A:
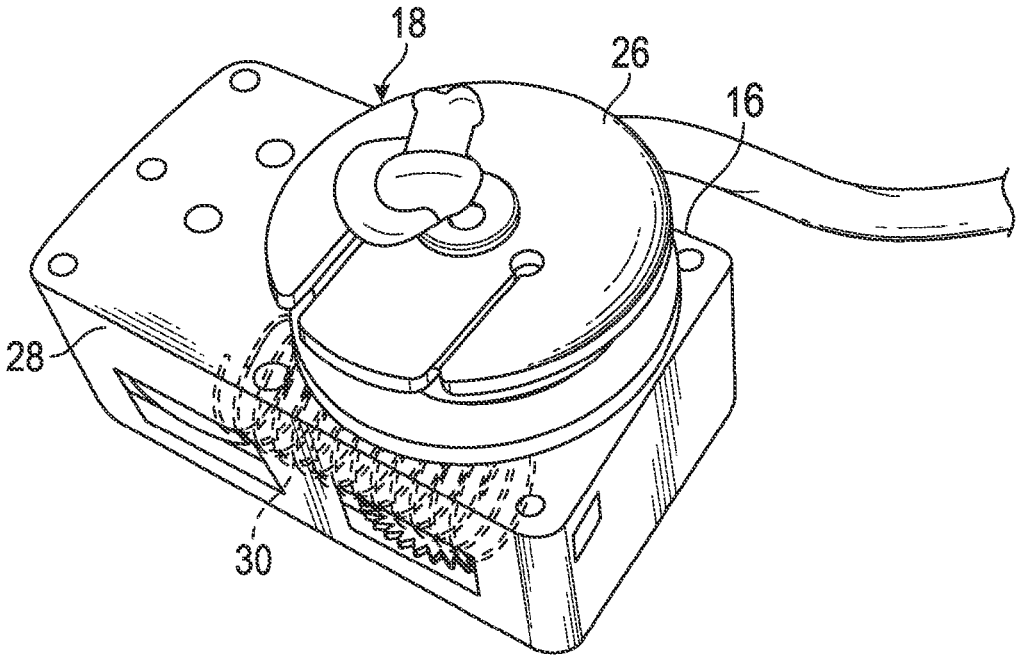
FIG. 5A is a perspective view of a component of the timer mechanism.
Figure 5B:
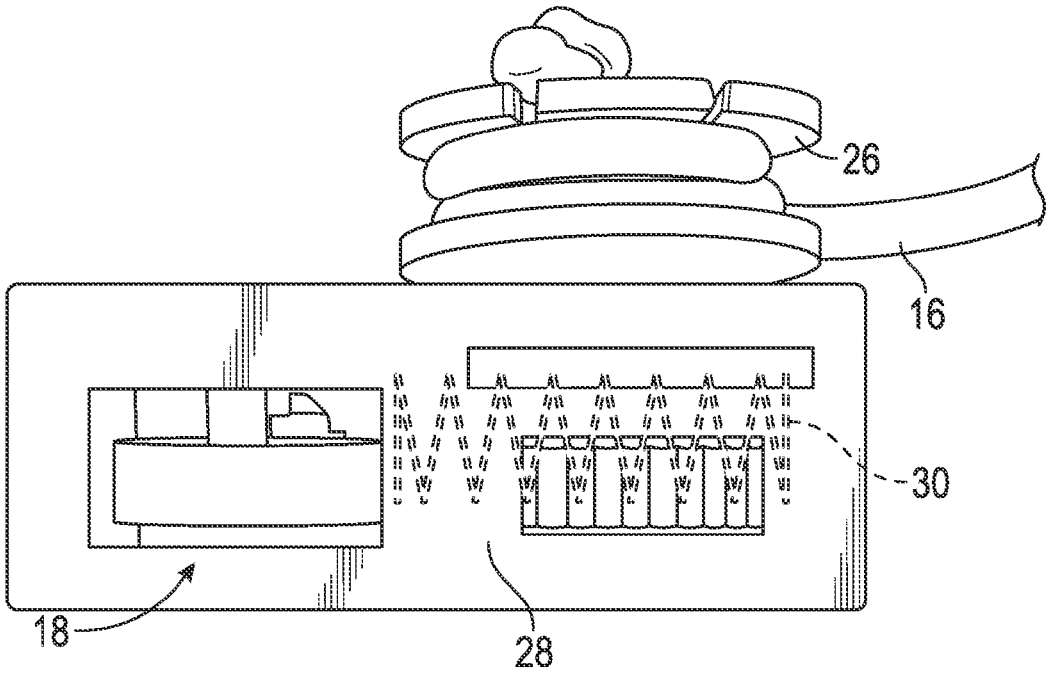
FIG. 5B is a side view of a component of the timer mechanism.
Figure 5C:
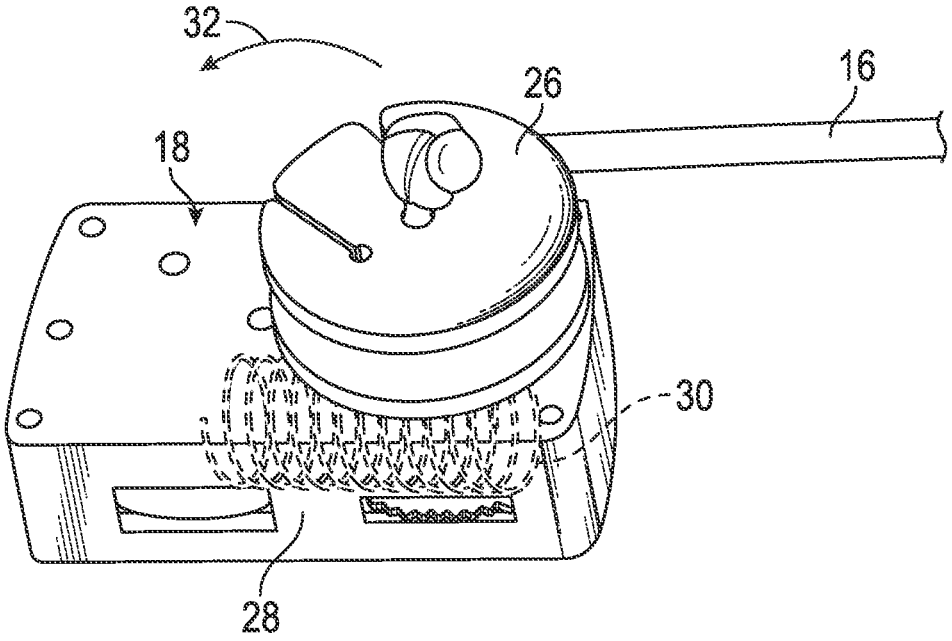
FIG. 5C is another perspective view of the component of the timer mechanism.

FIG. 4 illustrates an interior of the object 14 with a portion of the housing 29 of the object 14 removed so that the location of the winding mechanism 18 is viewable. FIGS. 4A and 4B are front and rear views of the object 14.

Figure 1B:
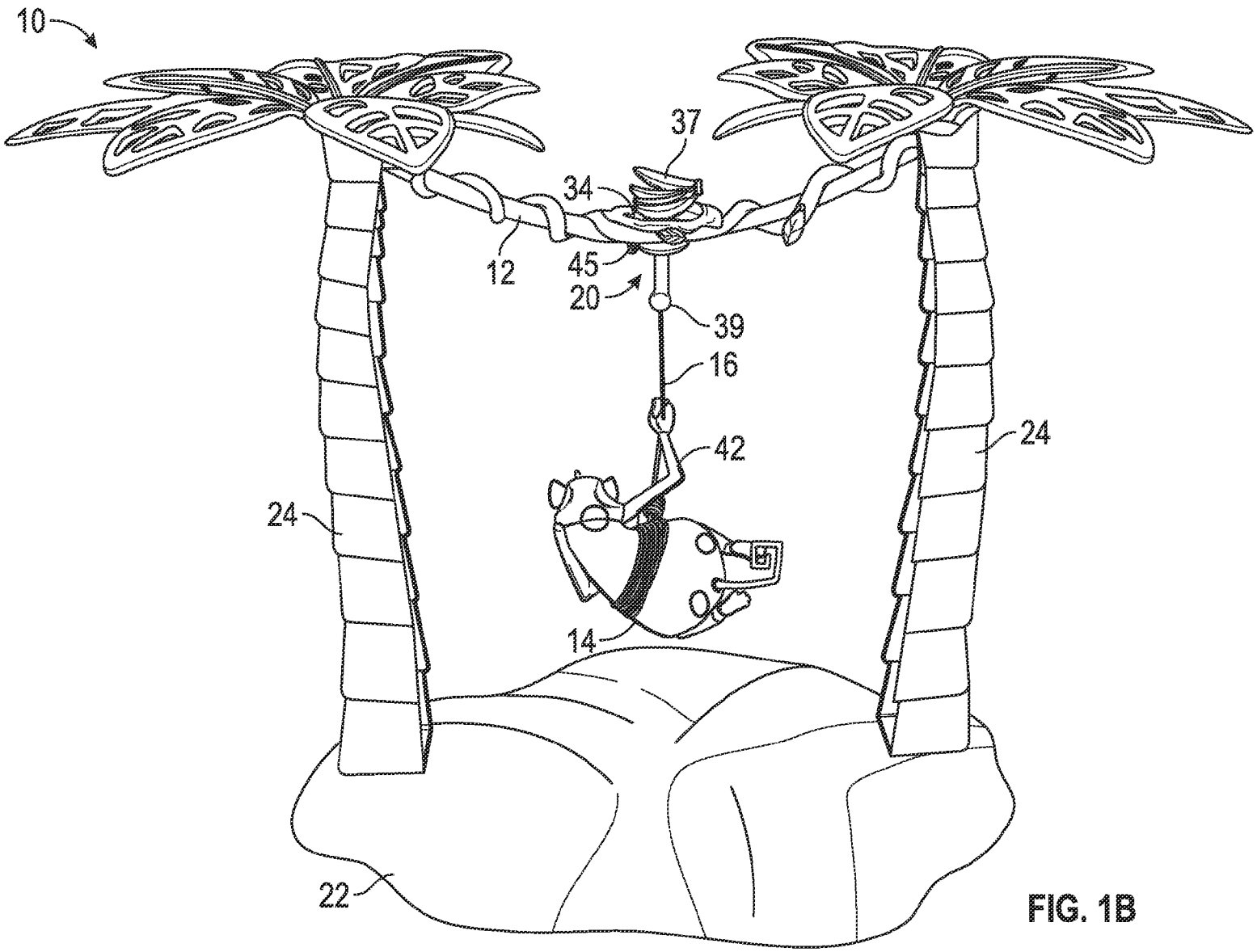
FIG. 1B is a perspective view of the timer mechanism at an intermediate position.
Figure 1C:
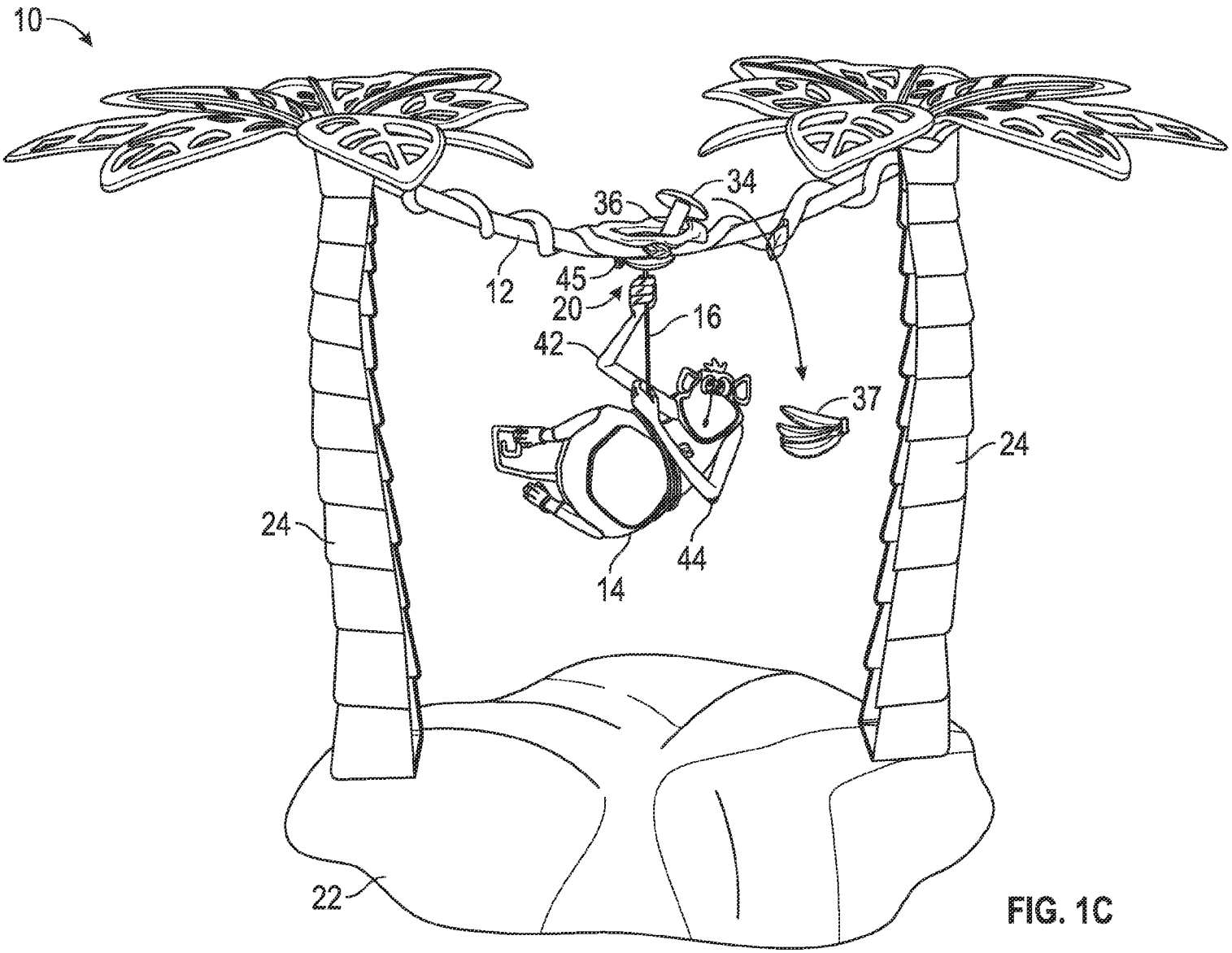
FIG. 1C is a perspective view of the timer mechanism at a second or final position.
Figure 2:
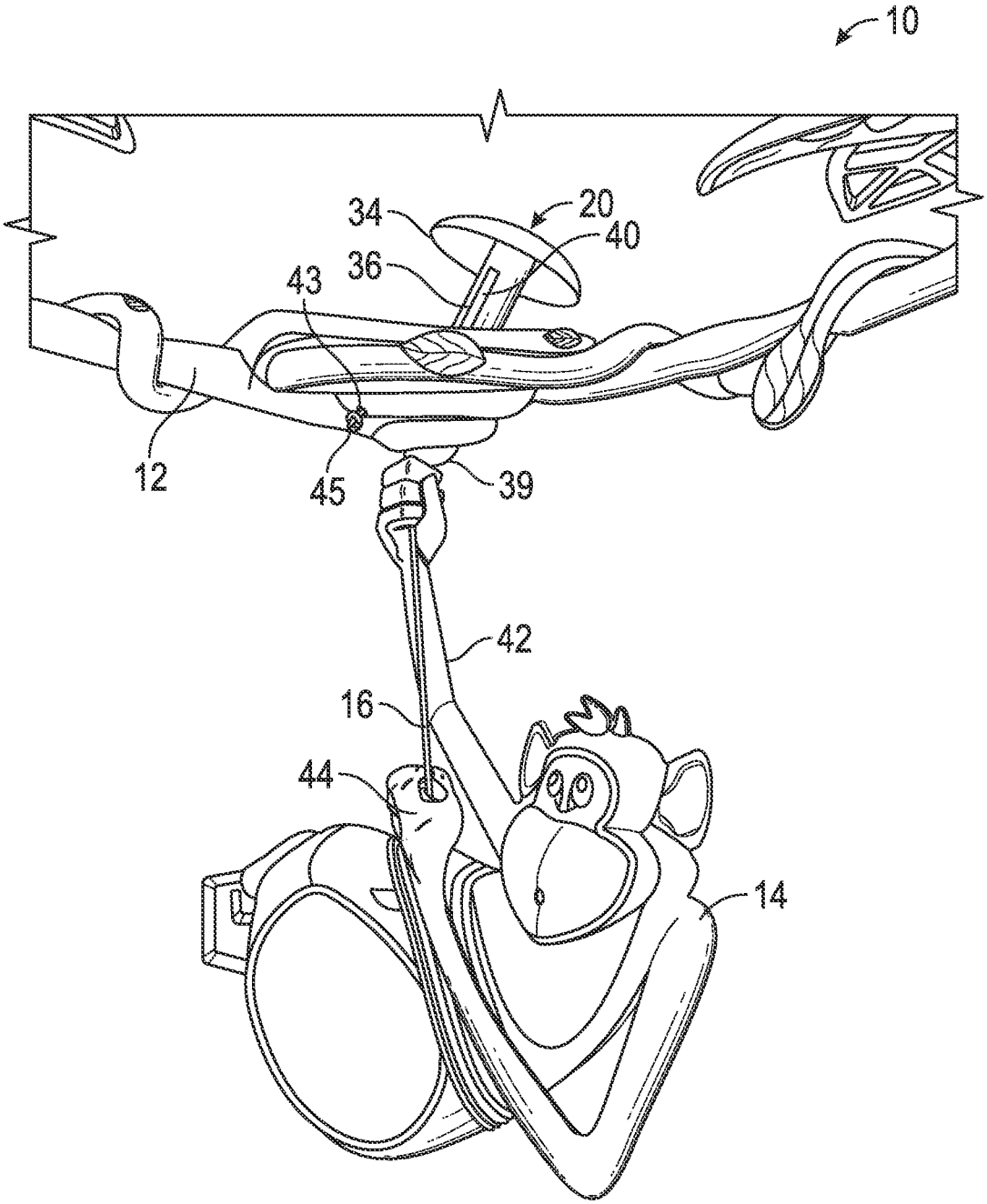
FIG. 2 is a close-up view of the timer mechanism in the second or final position.
Figure 3A:
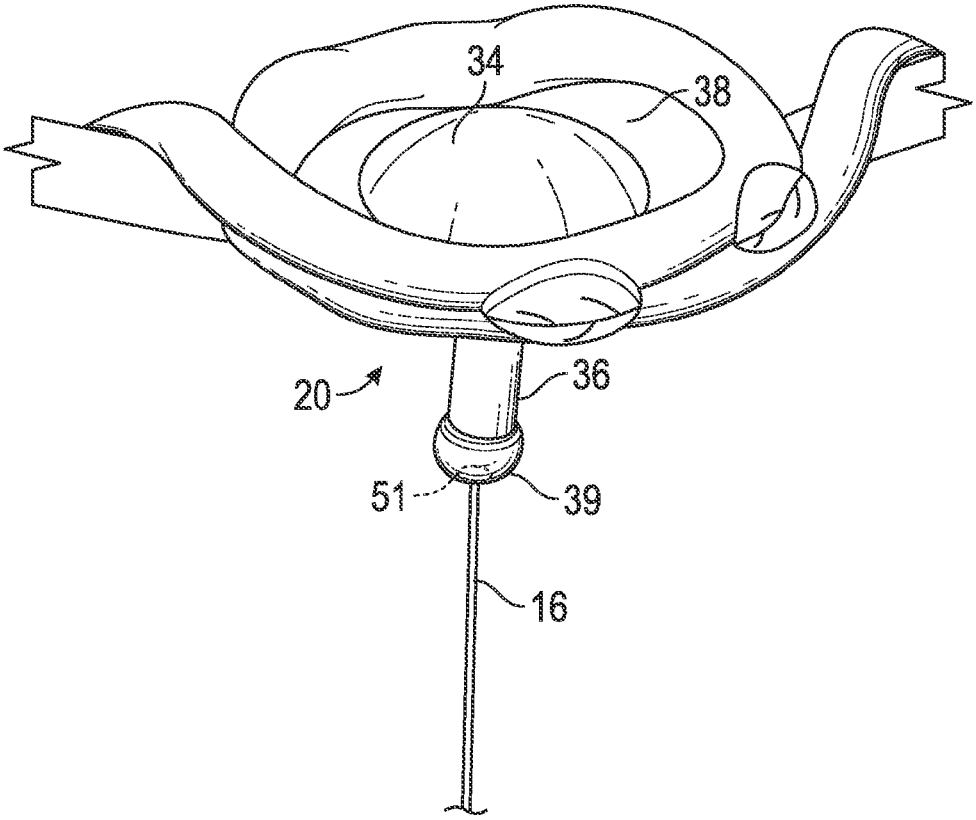
FIG. 3A is a close-up view of an indicator of the timer mechanism in a first position.
Figure 3B:
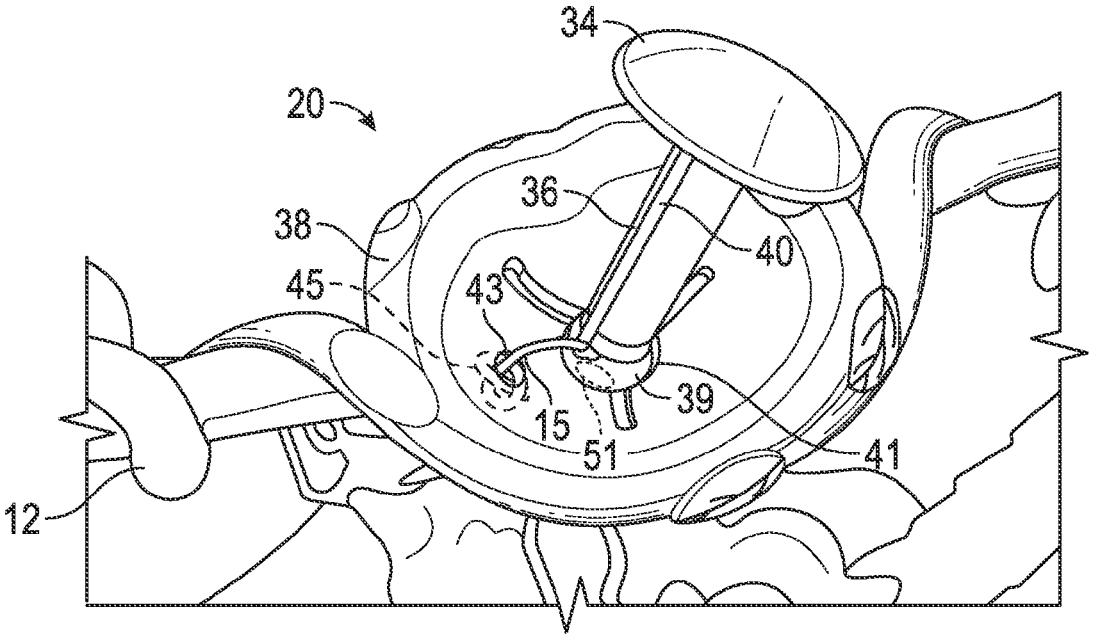
FIG. 3B is a close-up view of the indicator of the timer mechanism in a second position.

Referring now to FIGS. 1A-3B and in one embodiment, the indicator mechanism 20 has a head portion 34 and a shaft portion 36 furthermore and in one embodiment, the indicator mechanism may also include a displaceable member 37 as will be discussed below. The shaft portion 36 is slidably mounted to the cord 16 proximate to the elevated portion 12 such that as the object 14 approaches the elevated portion 12 a portion of the object contacts the shaft portion 36 of the indicator mechanism 20 and causes the shaft portion 36 to move from a first position (FIGS. 1A, 1B and 3A) to a second position (FIGS. 1C, 2 and 3B).

As the indicator mechanism 20 moves from the first position to the second position, the head portion 34 is dislodged or elevated from a recessed area 38 of the elevated portion 12. In one embodiment and as the head portion 34 moves from the first position to the second position, the displaceable member 37 is dislodged and falls from the elevated portion 12. As illustrated in at least FIGS. 1A-3B, the head portion 34 is configured to be received in the recessed area 38 when the indicator mechanism 20 is in the first position. This dislodging or elevating of the head portion 34 from the recessed area 38 gives an indication that the object 14 has moved from an initial or starting position (FIG. 1A) to a second or final position (FIGS. 1C and 2). When the indicator mechanism 20 has reached its second position or when the head member 34 is elevated from the recessed area 38, the time period for a player in the game has elapsed. In some embodiments, the dislodging of the displaceable member 37 from the elevated portion 12 indicates the elapsed time period. Accordingly, movement of the head member 34 from the recessed area 38 provides a visual indicator of an expiration of the predetermined time period.

In addition, the indicator mechanism 20 may also provide a warning or visual indication that the end of the predetermined time period is about to expire. For example, once the object 14 initially contacts shaft portion 36 and head member 34 begins to move this movement will provide a visual indication that the predetermined time period is about to expire. The final indication of expiration of the predetermined time period will be when head portion 34 is completely elevated (e.g., shaft portion 36 is no longer moving upward due to contact with the object 14 or when object 14 contacts elevated portion 12) from the recessed area 38 and/or the accessory piece or hand of bananas 37 is completely dislodged (e.g., falls) from the recessed area 38.

As mentioned above, the indicator mechanism 20 may additionally include a displaceable member 37, which is dislodged from the elevated portion 12 due to the movement of mechanism 20. In one embodiment, the movement of the displaceable member 37 may provide the visual indicator of the expiration of the predetermined time period. For example and when the displaceable member 37 is dislodged and falls from the elevated portion 12, the visual indication of the expiration of the predetermined time period has occurred. In one embodiment, the displaceable member 37 may be an accessory piece of the game or toy wherein the accessory piece is in the shape of a hand of bananas. The accessory piece 37 is placed in contact with the head member 34 when the retractable member 16 is in its extracted position from the object 14. For example, the accessory piece may be placed on top of the illustrated head member 34 in the recessed area 38. When the object 14 dislodges the head portion 34, the head portion 34 displaces the accessory piece 37, and at a certain point in the displacement, the accessory piece 37 becomes completely displaced from the recessed area 38. In some embodiments, the accessory piece 37 falls out of the recessed area 38, thus indicating the expiration of the predetermined time period.

In order to allow for the shaft 36 to slide along the cord 16, the shaft 36 has an elongated slot or opening 40 that extends into an opening 51 (illustrated by the dashed lines in FIGS. 3A and 3B located at an end or lower end 39 of shaft 36, which allows the cord 16 to pass therethrough and allows shaft 36 to slide along a portion of the cord secured proximate to the recessed area 38 as the object 14 contacts the lower end 39 of shaft 36. Also shown is that the recessed area 38 has an opening 41 that allows the shaft to slide therethrough. As mentioned above, end 15 of the cord 16 may be secured to the elevated portion 12 proximate to opening 41 by for example passing though opening 41 and then a second opening 43 wherein end 15 is secured thereto by any suitable means such as a knot 45 that is formed in end 15 after it has passed through opening 43 and is larger than opening 43 so that end 15 of cord 16 is secured to the elevated portion 12. Alternatively, knot 45 may be replaced with a ring or item 45 that may be secured to end 15 after it has passed through opening 41, wherein ring or item 45 is larger than opening 43 so end 15 is effectively secured to elevated portion 12.

In one embodiment, the object 14 has an arm member 42 extending therefrom. The arm member 42 is configured to contact the shaft portion 36 of the indicator mechanism 20 as the object 14 reaches the elevated portion 12. In one implementation, the cord 16 is slidably received within openings in the arm member 42.

In one non-limiting embodiment, the object 14 is configured to resemble a monkey and the elevated portion 12 is configured to resemble a vine extending between two palm trees 24. Accordingly and as the object 14 is drawn towards the elevated portion 12 via winding mechanism 18, the monkey appears to be climbing up towards the elevated portion 12. As the monkey 14 approaches the elevated portion 12, its arm 42 contacts shaft 36 and the indicator mechanism 20 slides upwardly in the direction of arrow 17. During this movement the head member 34 of the indicator mechanism 20 becomes dislodged or elevated from the elevated portion 12.

Thus, the timer mechanism 10 in one embodiment provides the appearance of a monkey climbing up a vine, and the time for the monkey to climb to the elevated position is the predetermined time period for a player's turn in the game.

In an alternative embodiment, an accessory piece in the shape of a hand of bananas is placed on top of the head member 38, and when the monkey 14 dislodges the head member 38, which in turn causes the hand of bananas to fall from the vine, the predetermined time period ends.

In another embodiment, the object may further comprise a second arm member 44, wherein the cord 16 is also slidably received within the second arm member.

Thus, in the illustrated embodiment, a cord 16 is attached at one end to a spool member 26 of a winding mechanism 18 mounted within a housing 29 of an object 14. From its attachment to the spool member 26, the cord 16 exits the object 14 through an opening in the housing 29 of the object 14. The cord 16 extends through one or more cord guides, such as an upper arm 42 and a lower arm 44. The cord guides assist in preventing the cord 16 from becoming tangled. From the cord guides, the cord 16 extends through a shaft portion 36 of an indicator mechanism 20 via an opening 51 in the lower end or end 39 of shaft portion 36 and an elongated slot 40 of the shaft portion 36. From the elongated slot 40, the other end 15 of the cord 16 terminates in a securement to an elevated portion 12, such as in a knot larger than an opening 43 in a bottom surface of the elevated portion 12.

When the cord 16 is extracted from the object 14 with the winding mechanism 18 (i.e. the object is placed in an extended position from the indicator mechanism), the added length of the cord 16 outside of the object 14 allows the shaft 36 to pass through and extend below an opening 41 in the recessed area 38, such as shown in FIGS. 1A and 1B. The added length of the cord 16 allows the cord 16 to pass into the shaft 36 at a higher point in the elongated slot 40. A head portion 34 on the indicator mechanism 20 attached to an upper end of the shaft 36 prevents the shaft 36 from sliding completely through the opening 41 of the recessed area 38.

At some point when the cord 16 retracts into the object 14 via the winding mechanism 18, an indicator engagement portion (here, the upper arm 42) makes contact with a lower end 39 of the shaft 36. As the cord 16 continues to retract into the object 14, the indicator engagement portion pushes the lower end 39 of the shaft 36 back towards the opening 41 of the recessed area 38. With less of the length of cord 16 available, the cord 16 passes through continually lower and lower points in the elongated slot 40, until the cord 16 passes through the lowest point in the elongated slot 40 and/or the lower end 39 of the shaft 36 engages the bottom of the opening 41 of the recessed area 38. Because the lower end 39 of the shaft 36 is larger than the bottom of the opening 41 of the recessed area 38 in the illustrated embodiment, the lower end 39 of the shaft 36 becomes lodged in the bottom of the opening 41 of the recessed area 38, and the shaft 36, along with the object 14, ceases to travel.

As the object 14 pushes the shaft 36 upwards while the length of the cord 16 outside the object 14 shortens, the head 34 of the indicator mechanism 20 is also displaced, thus providing a physical and observable indication of the lapse of a time period. As indicated previously, the displacement of the head 34 of the indicator mechanism 20 may also be tied in with mechanisms for other physical and observable indicators, such as the displacement of an accessory piece 37 from the recessed area 38 by movement of the head 34.

Other embodiments may not have an indicator engagement portion. Instead, the area around the opening in the object 14 or another portion of the object 14 may engage the lower end of the shaft 36 directly. Some embodiments may not include any cord guides, such that the cord 16 travels directly from an opening in the object 14 to the indicator mechanism 20.

Figure 6:
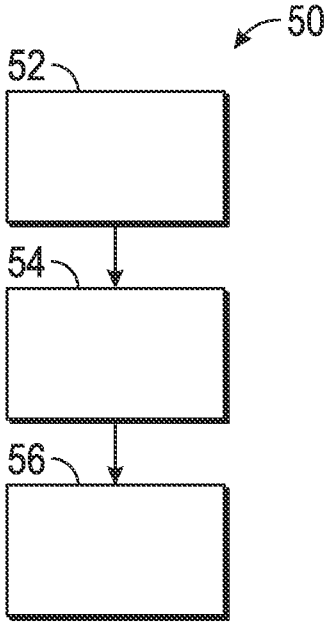
FIG. 6 is a flow chart illustrating a method of timing a player's turn in a game

Referring now to FIG. 6, a method 50 for timing a player's turn in a game using the timer mechanism of various embodiments of the present invention is illustrated. At a first step 52, the object 14 of the timing mechanism is retracted from a first position to a second position. The retraction of the object 14 from the first position to the second position extracts the retractable member or cord 16 from a contracted configuration to an extracted configuration, where the retractable member or cord 16 is unwound from a winding device 18 located within the object 14. In the illustrated embodiments, the object 14 is retracted from a first elevated position to a second lowered position. The retraction may occur in a direction or axis perpendicular to a playing surface. In other embodiments, the object 14 may be retracted laterally, or parallel to a playing surface or in any other direction with respect to the first playing surface.

After step 52 is performed, the object 14 is released from the first position and the winding mechanism 18 retracts the retractable member 16 into the object 14 causing the object 14 to be drawn from the second position back towards the first position.

Once the object 14 reaches the first position, the object 14 at step 56 activates the indicator mechanism 20. For example, the object 14 may contact and apply a force to the indicator mechanism 20 as described above or simply activate the indicator mechanism when the object 14 reaches a timer end position. The activation of indicator mechanism 20 provides a visual indication that a time period for a player or players (e.g., multiple players performing the same task at once) to perform a required task in the game has expired. In other words, the time period required for the object 14 to travel from the first position to the elevated position in which the object 14 activates the indicator mechanism 20 is the maximum period of time allowed for the player's turn in the game. In the illustrated embodiments, the object 14 dislodges a head portion 34 of the indictor mechanism 20 to indicate the end of the predetermined time period. In other embodiments, the object 14 dislodges a head portion 34 of the indicator mechanism 20, which in turn displaces a displaceable member 37 to indicate the end of the predetermined time period.

Accordingly, a game and method of playing the game using a retractable string device as a timer in the game is provided. In one implementation, the retractable string device is located within a housing or figure that represents a character or theme associated with the game. The game has at least one structure configured so that the retractable string device hangs from an elevated position of the structure and can be pulled downwardly away from the elevated position of the structure and then released. Once released, the string is drawn into the device, and the device is drawn upwardly back towards the elevated position of the structure.

As the device travels upwardly towards the elevated position, the time required for this movement is also the time allowed for a player's turn in the game. In one embodiment, the structure can be configured to releasably retain an indicator mechanism or item 20 that is moved or dislodged by the device or in an alternative embodiment is transferred (e.g., hook and fastener means) to the device once it reaches the elevated position. In one embodiment, a player must pull the object 14 away from the elevated portion 12 prior to the activation of the indicator mechanism either by transference of the item to the object 14 or the dislodging of the item by the object 14.

As mentioned above and in one embodiment, the structure or elevated portion 12 is configured to activate an indicator mechanism or item 20 that is dislodged or moved upwardly when the object 14 reaches the elevated position. This item 20 when moved upwardly provides an indicator means for providing a visual recognition that the object 14 has reached the elevated position and the time for a player to perform their task in the game has elapsed.

One non-limiting method of gameplay may be described as follows: a first player pulls the device from the elevated position and releases it. This starts another player's turn wherein they perform an act or acts required in the game. This player must then pull the device back down and release it before it reaches the elevated position thus starting another player's turn who must then perform the act or acts required in the game.

In one embodiment, the act required in the game may be the removal of game pieces removably secured to the structure, and the winner of the game is the player possessing the highest amount of removed pieces when no more removable game pieces are secured to the structure.

Accordingly, the retractable device acts as a timer in the game. Should the retractable device reach the elevated position prior to a player pulling it back down, that player is penalized in accordance with game rules by for example, returning a predetermined amount of game pieces in their possession back to the structure. As mentioned above, the movable object acts as an indicator that the retractable device contacted the elevated position prior to it being pulled down by a player of the game.

In one implementation, the retractable string device is located within a housing or figure that represents a character or theme associated with the game. The structure is configured so that the retractable string device hangs from an elevated position of the structure (e.g., un-retracted position) and can be pulled downwardly away from the elevated position of the structure (e.g., retracted position) and then released. Once released, the string is drawn into the device by the mechanism and the same is drawn upwardly back towards the elevated position or unretracted position. Accordingly and as the device travels upwardly towards the elevated position, the time required for this movement is also the time allowed for a player's turn in the game.

The predetermined time period or the time allowed for a player's turn may be adjusted during construction or manufacturing of the timing mechanism 10 by varying such factors as the length of the retractable member 16 and the speed/torque at which the winding mechanism 18 operates.

Figure 7:
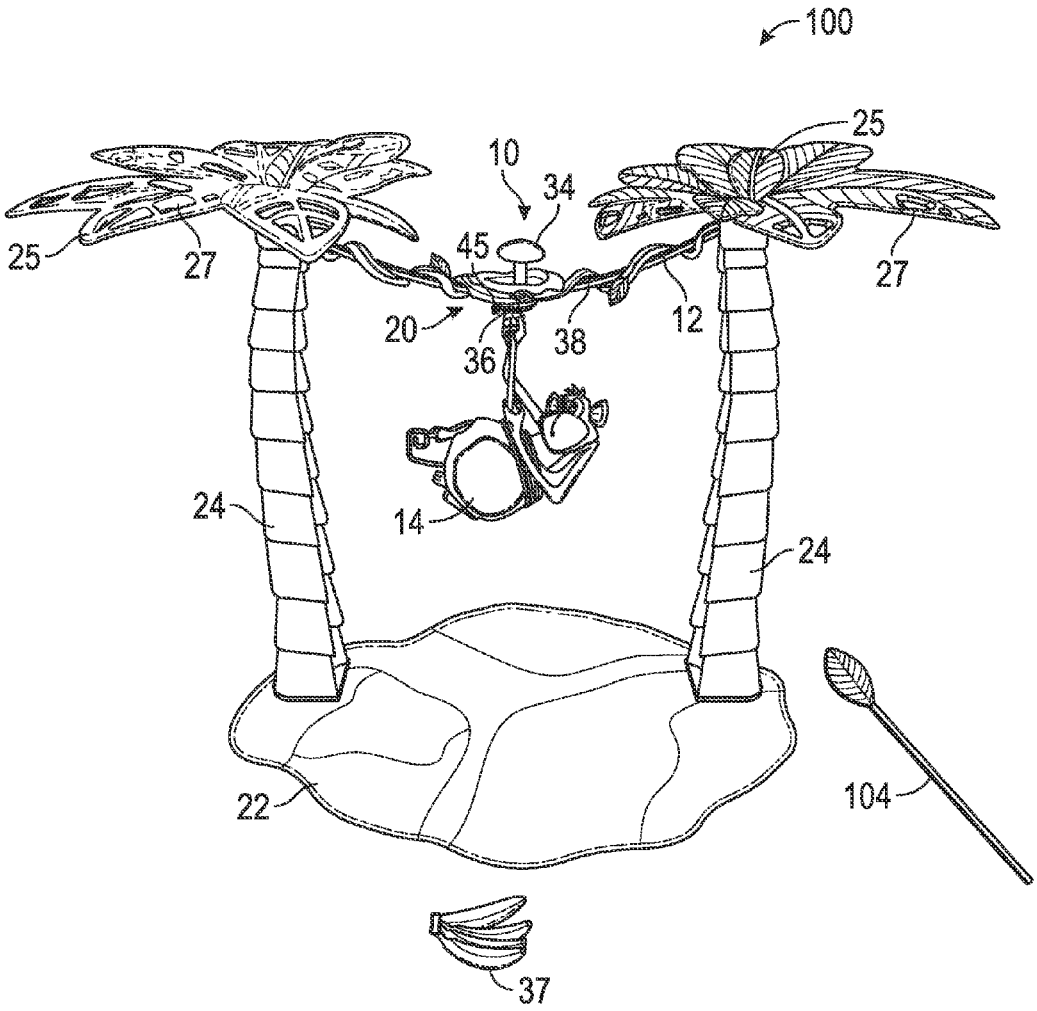
FIG. 7 illustrates a game according to an embodiment of the present invention.
Figure 8:
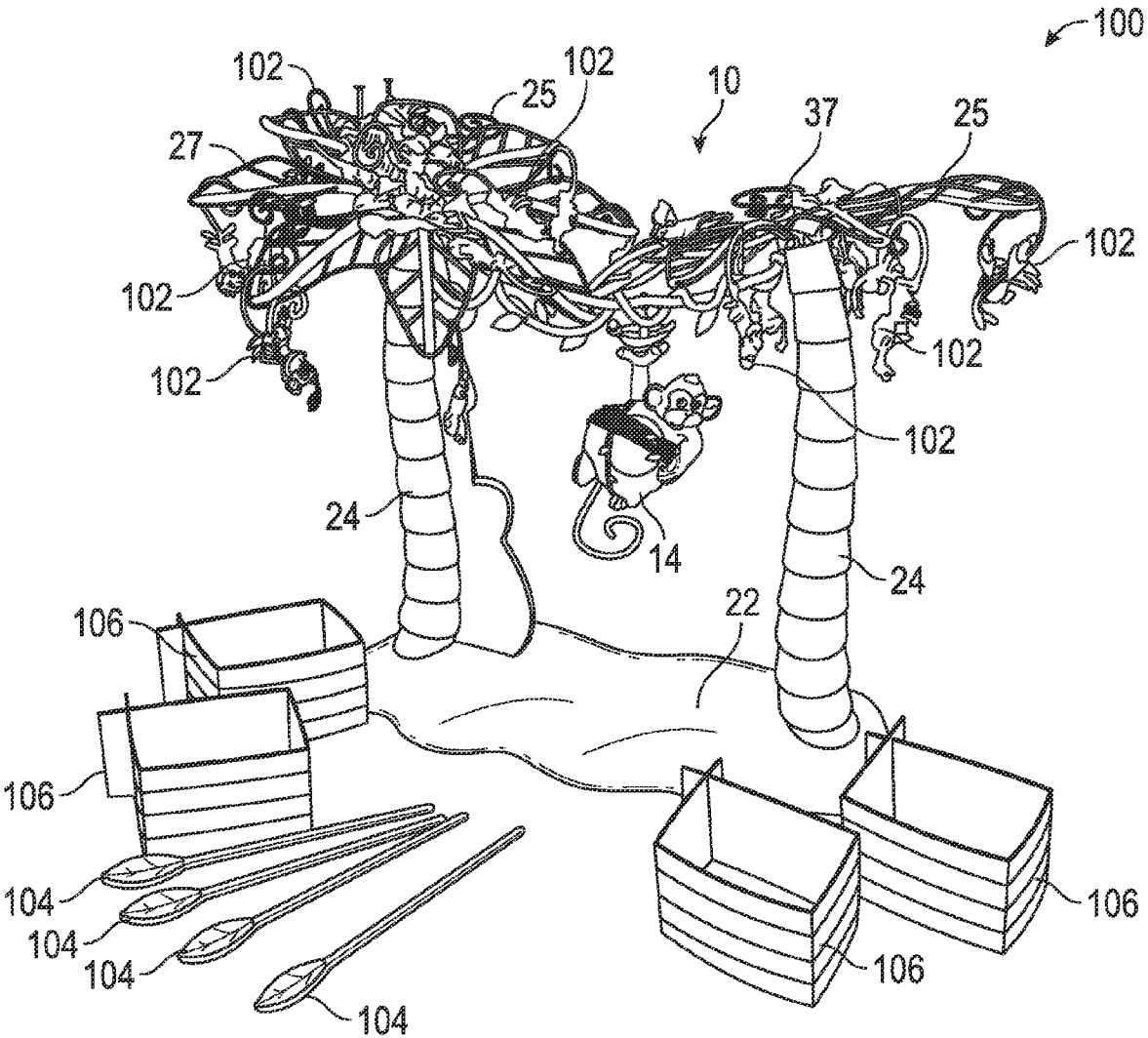
FIG. 8 illustrates a game according to an alternative embodiment of the present invention.

FIGS. 7 and 8 illustrate a game 100 used with the timer mechanism 10 and the aforementioned method of playing the game. In FIG. 7, the accessory or hand of bananas 37 is dislodged from the receiving area 38 by the head member 34 as mentioned above. In FIG. 8, the accessory or hand of bananas 37 is captured or retrieved by the object when it reaches the first or elevated position. In this embodiment, a releasable means of attachment (e.g., hook and fastener) may be used to allow the object 14 to releasably grasp the accessory or hand bananas 37 when it reaches the first or elevated position.

Figure 9:
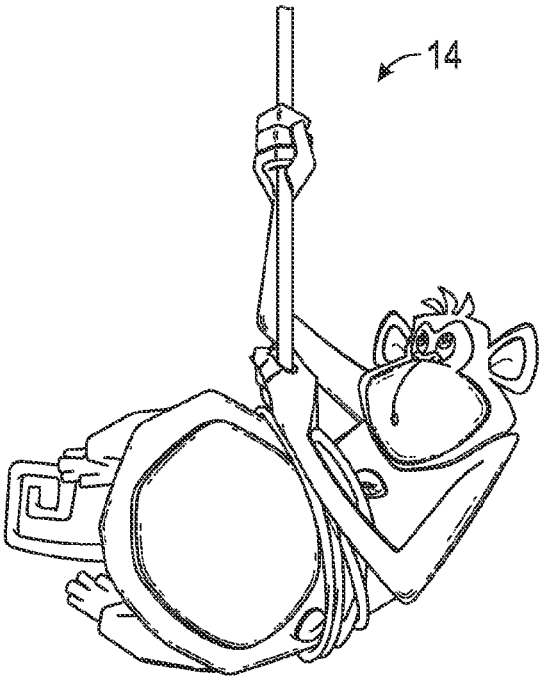
FIGS. 9 and 10A-10C illustrates components of the game in accordance with various embodiments of the present invention.
Figure 10A:
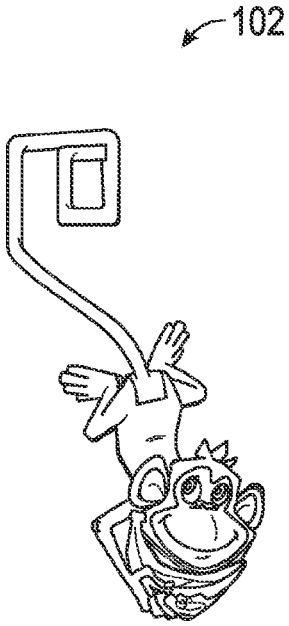
Figure 10B:
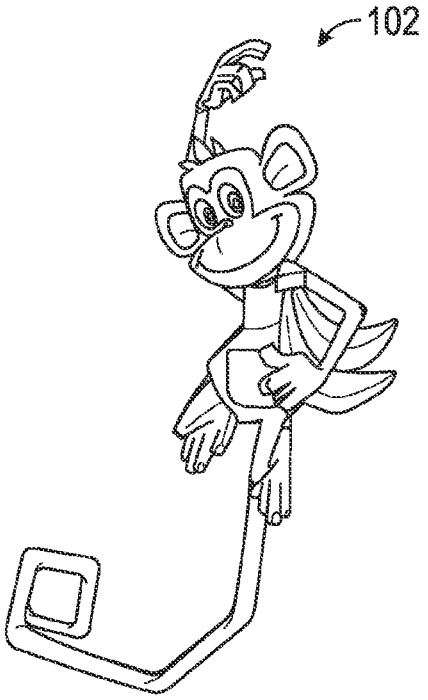
Figure 10C:
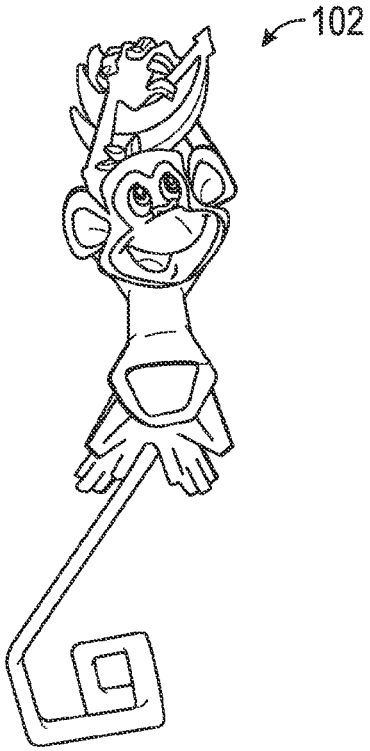

Also shown in FIGS. 7 and 8 is that each of the vertical members 24 are configured to resemble a pair of trees or palm trees each having leaf portions or leaves 25. Each of the leaf portions or leaves 25 have at least one or a plurality of openings 27. The at least one or plurality of openings 27 allow for game pieces 102 (see also FIG. 10A-10C) to be placed on the vertical members 24. In some embodiments, the game pieces 102 are configured to have hook members or features that allow them to either hang from portions of the vertical members 24 (e.g., leaves 25 the openings 27). Alternatively, the game pieces 102 are simply placed upon portions of the vertical members 24. FIG. 9 also illustrates one non-limiting configuration of object 14.

Also shown in FIGS. 7 and 8 are wand members 104. Wand members 104 are in one embodiment, used by the player or players to remove the game pieces 102 from the vertical members 24. In some embodiments, the game 100 is also provided with a plurality of receptacles 106 for each of the players to place their game pieces 102 therein after they have been removed from the vertical members 24.

As mentioned above and in one embodiment, the object of the game and object of the method of playing the game is to be the player with the most game pieces 102 (e.g., monkeys) in their barrel (e.g., receptacles 106) after all of the game pieces have been removed from the trees (e.g., vertical members 24).

In one non-limiting embodiment, the game is set up by placing all of the game pieces 102 into the tree structure (e.g., vertical members 24). Thereafter, each player takes a turn removing as many game pieces 102 as possible from the structure using the wand 104 and placing them in their respective receptacle 106. During a player's turn they must reset the timer mechanism 20 before it reaches the first position and activates the indicator mechanism. Once they reset the timer mechanism 20 by pulling it back from the first position towards the second position the next player's turn begins. Should a player fail to reset the timer mechanism prior to its activating of the indicator mechanism during their turn that player is penalized in accordance with game rules by for example returning a predetermined amount of game pieces 102 from the receptacle 106 back onto the structure. Game play continues until there are no more game pieces 102 on the structure and the winner is determined by the player who has the most amount of game pieces 102 in their receptacle 106.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

In the preceding detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated.

This written description uses examples to disclose the invention, including the best mode, and to enable any person skilled in the art to practice the invention, including making and using any devices or systems.

What is claimed is:

1. A timer mechanism for a game is provided, the timer mechanism comprising:

an end portion;

an object secured to the end portion by a retractable member capable of being extracted from the object and retracted into the object by a winding mechanism, wherein the retractable member is a cord secured to the end portion at one end and the winding mechanism at the other end; and an indicator mechanism located at the end portion for indicating when the object has come into proximity with the end portion and has contacted a portion of the indicator mechanism through retraction of the retractable member into the object by the winding mechanism, wherein the indicator mechanism is slidably mounted to the cord proximate to the end portion.

2. The timer mechanism as in claim 1, wherein the indicator mechanism has a head portion and a shaft portion, the shaft portion being slidably mounted to the cord proximate to the end portion.

3. The timer mechanism as in claim 2, wherein the end portion has a recessed area configured to receive the head portion therein and the shaft portion is slidably received within an opening in the recessed area and wherein the timer mechanism further comprises a displaceable member configured to be received within the recessed area, wherein the displaceable member is dislodged from the recessed area when the object has come into contact with the shaft member.

4. The timer mechanism as in claim 2, wherein the object has an arm member extending therefrom, the arm member being configured to contact the shaft portion as the object reaches the end portion.

5. The timer mechanism as in claim 4, wherein the cord is slidably received within the arm member and wherein the end portion is elevated when the arm member contacts the shaft portion.

6. The timer mechanism as in claim 1, wherein the winding mechanism has a spool member rotatably mounted to a housing of the winding mechanism, wherein the spool member is coupled to a spring member configured to rotate the spool member in a first direction after the spool member has been rotated in a second direction, the second direction being opposite to the first direction and wherein the second direction corresponds to the extraction of the retractable member from the object, wherein the retractable member is a cord secured to the elevated portion at one end and the spool member at an opposite end.

7. The timer mechanism as in claim 6, wherein the indicator mechanism has a head portion and a shaft portion, the shaft portion being slidably mounted to the cord proximate to the end portion.

8. The timer mechanism as in claim 7, wherein the end portion is an elevated portion and has a recessed area configured to receive the head portion therein and the shaft portion is slidably received within an opening in the recessed area.

9. A game, comprising:

a structure;

an object secured to the structure by a retractable member capable of being extracted from the object and retracted into the object by a winding mechanism, wherein the retractable member is a cord secured to the structure at one end and the winding mechanism at an opposite end; and an indicator mechanism operatively coupled to the structure for indicating when the object has contacted a portion of the indicator mechanism after the retractable member has been extracted from the object, wherein the indicator mechanism is slidably mounted to the cord proximate to the structure.

10. The game as in claim 9, wherein the winding mechanism has a spool member rotatably mounted to a housing of the winding mechanism, wherein the spool member is coupled to a spring member configured to rotate the spool member in a first direction after the spool member has been rotated in a second direction, the second direction being opposite to the first direction and wherein the second direction corresponds to the extraction of the retractable member from the object, wherein the retractable member is a cord secured to the structure at one end and the spool member at an opposite end.

11. The game as in claim 9, wherein the indicator mechanism has a head portion and a shaft portion, wherein the shaft portion has an elongated slot configured to slidably receive a portion of the retractable member.

12. The game as in claim 11, wherein the retractable member is a cord secured to an elevated portion of the structure at one end and the winding mechanism at the other end and the elevated portion has a recessed area configured to receive the head portion therein and wherein the shaft portion is slidably received within an opening in the recessed area.

13. The game as in claim 12, wherein the object has an arm member extending therefrom, the arm member being configured to contact an end portion of the shaft portion as the object reaches the elevated portion.

14. The game as in claim 13, wherein the cord is slidably received within the arm member.

15. The game as in claim 13, wherein indicator mechanism has a head portion and a shaft portion depending therefrom, wherein the head portion is configured to be received within a recessed area of the structure and wherein the shaft portion has an elongated slot configured to slidably receive a portion of the retractable member therein and wherein the indicator mechanism further comprises a displaceable member configured to be received within the recessed area, wherein the displaceable member is dislodged from the recessed area when the object contacts the shaft member after the retractable member has been extracted from the object.

16. A method of playing a game, the method comprising the steps of:

locating at least one game piece on a structure;

executing a plurality of player's turns in the game until a predetermined event has occurred, wherein each player's turn includes the steps of:

interacting with the at least one game piece on the structure during a predetermined time period;

repositioning an object away from the structure to a timer start position in order to create a predetermined time period for the next player's turn in the game, wherein the repositioning of the object away from the structure causes a retractable member to be unwound from a winding device located within the object, wherein the retractable member is a cord secured to the structure at one end and the winding device at the other end, and wherein the unwinding of the retractable member causes the object to be drawn towards a timer end position;

wherein a player is penalized if during their turn the object reaches the timer end position and contacts a portion of an indicator mechanism prior to it being repositioned away from the structure to the timer start position, wherein the indicator mechanism is slidably mounted to the cord proximate to the structure; and determining a winner of the game when the predetermined event has occurred.

17. The method as in claim 16, wherein the timer start position is further away from the structure than the timer end position.

18. The method as in claim 16, wherein the at least one game piece is a plurality of game pieces and the timer end position is elevated from the timer start position and wherein the predetermined event is when there are no more objects on the structure.

* * * * *